US010295302B2

(12) United States Patent
Lort

(10) Patent No.: US 10,295,302 B2
(45) Date of Patent: May 21, 2019

(54) CO2 STOCK WITH QUICK LATCH SYSTEM

(71) Applicant: Wolverine Airsoft, LLC, Kingsport, TN (US)

(72) Inventor: Rich Lort, Kingsport, TN (US)

(73) Assignee: Wolverine Airsoft LLC, Kingsport, TN (US)

( * ) Notice: Subject to any disclaimer, the term of this patent is extended or adjusted under 35 U.S.C. 154(b) by 23 days.

(21) Appl. No.: 15/444,787

(22) Filed: Feb. 28, 2017

(65) Prior Publication Data

US 2017/0299321 A1 Oct. 19, 2017

Related U.S. Application Data

(60) Provisional application No. 62/305,888, filed on Mar. 9, 2016.

(51) Int. Cl.

| | |
|---|---|
| ***F41B 11/62*** | (2013.01) |
| ***F17C 7/04*** | (2006.01) |
| ***F41B 11/642*** | (2013.01) |
| ***F41B 11/723*** | (2013.01) |
| ***F41B 11/724*** | (2013.01) |
| ***F17C 11/00*** | (2006.01) |
| ***F17C 13/08*** | (2006.01) |

(52) U.S. Cl.

CPC ..... *F41B 11/62* (2013.01); *F17C 7/04* (2013.01); *F17C 13/084* (2013.01); *F41B 11/642* (2013.01); *F41B 11/723* (2013.01); *F41B 11/724* (2013.01); *F17C 2201/0109* (2013.01); *F17C 2201/058* (2013.01); *F17C 2205/0111* (2013.01); *F17C 2205/0115* (2013.01); *F17C 2205/0153* (2013.01); *F17C 2205/0338* (2013.01); *F17C 2221/013* (2013.01); *F17C 2223/013* (2013.01); *F17C 2225/0123* (2013.01); *F17C 2265/06* (2013.01); *F17C 2270/0736* (2013.01)

(58) Field of Classification Search

CPC ..... F41B 11/62; F17C 17/04

See application file for complete search history.

(56) References Cited

U.S. PATENT DOCUMENTS 4,830,056 A * 5/1989 Chamberlain ..... F17C 7/00 137/545

5,878,736 A * 3/1999 Lotuaco, III ..... F41B 11/52 124/71

(Continued)

*Primary Examiner* — Bret Hayes

(74) *Attorney, Agent, or Firm* — Pitts & Lake, P.C.

(57) ABSTRACT

An in-stock compressed gas delivery assembly to deliver gas to an airsoft gun, including a cartridge receiving portion to receive at least a portion of a compressed fluid cartridge, a locking cap to secure the compressed fluid cartridge in the gas delivery assembly, a puncture pin assembly to puncture a nozzle of the compressed fluid cartridge when the locking cap is closed over the cartridge, a regulator to regulate a volume of gas passing from the gas delivery assembly, and a plurality of expansion chambers configured to form a tortuous path, between the cartridge and the regulator, to expand liquid from the compressed fluid cartridge to gas, and a buffer tube having a first end configured to be coupled to the airsoft gun; and a second end configured to receive the gas delivery assembly such that the buffer tube houses at least a portion of the gas delivery assembly.

13 Claims, 10 Drawing Sheets

(56) References Cited

U.S. PATENT DOCUMENTS

| | | | | |
|---|---|---|---|---|
| 6,276,353 | B1 * | 8/2001 | Briggs | F41B 11/57 124/71 |
| 6,470,872 | B1 * | 10/2002 | Tiberius | F41B 11/51 124/74 |
| 7,334,598 | B1 * | 2/2008 | Hollars | F17C 13/04 137/116.3 |
| 2005/0011507 | A1 * | 1/2005 | Webb | F41B 11/57 124/71 |
| 2006/0027223 | A1 * | 2/2006 | Vasel | F41B 11/62 124/57 |
| 2009/0241931 | A1 * | 10/2009 | Masse | F41B 11/62 124/76 |
| 2011/0120437 | A1 * | 5/2011 | Tippmann, Jr. | F41B 11/55 124/74 |
| 2015/0300770 | A1 * | 10/2015 | Tseng | F41B 11/724 124/75 |

* cited by examiner

CO2 STOCK WITH QUICK LATCH SYSTEM

CROSS-REFERENCE TO RELATED APPLICATIONS

This Application claims the benefit of U.S. Provisional Patent Application Ser. No. 62,305,888, filed on Mar. 9, 2016, the content of which is incorporated herein by reference.

STATEMENT REGARDING FEDERALLY SPONSORED RESEARCH OR DEVELOPMENT

Not Applicable.

FIELD OF INVENTION

The present invention pertains generally to airsoft guns and, more particularly, to a high pressure fluid mechanism to be used in airsoft guns.

BACKGROUND

Airsoft guns are replica weapons that fire spherical non-metallic pellets rather than the lethal ammunition that the replica weapons are based upon. Airsoft also refers to a sport played with these airsoft guns that is similar to paintball, except that the pellets fired by the airsoft guns do not leave a color mark like that left by a paintball, and the participants typically play on the honor system of acknowledging when being hit by a pellet from an opponent's airsoft gun. Along with reduced mess, airsoft guns are typically cheaper to acquire and operate than paintball guns, and can also be used more easily for casual target practice when not engaged in competition. Airsoft guns employ compressed air to fire round these plastic pellets or similar projectiles, usually ranging from 0.12 g to 0.48 g.

Various "firing" mechanisms are known in the art for airsoft guns. For instance, U.S. Pat. No. 7,527,049, issued to Sheng, discloses a pneumatic pusher having a main body, a flow-guiding body, a moving body, and a delivery tube. The flow-guiding body includes a front tube with a smaller diameter and a rear tube with a larger diameter. The delivery tube is mounted on the front tube in such a way that the outer wall of the delivery tube and the inner wall of the main body define a return pressure chamber. A first gas-distributing channel extending from a first air outlet at one side of the main body leads directly to the inner side of the delivery tube. The side of the first air inlet of the main body communicates with a second gas-distributing channel. The second gas-distributing channel includes an exit located at one side of the return pressure chamber of the delivery tube. The air pressure provided through the second gas-distributing channel serves as cushioning force in pushing the delivery tube outwardly.

U.S. Pat. No. 8,453,633, issued to Tsai, discloses a spring-piston airsoft gun that includes a cylinder-and-piston assembly disposed in a barrel to force air through a muzzle end to make a shooting action, and a coil spring disposed to exert a biasing action to drive a piston head of the cylinder-and-piston assembly when changed from a compressed state to a released state. Front and rear anchor shanks are disposed for respectively mounting front and rear coil segments of the coil spring. A major shell and a minor ring are sleeved on the rear anchor shank to permit the coil spring to be sleeved thereon. The minor ring is in frictional contact with and angularly moveable relative to the major shell such that, when the coil spring is released to expand to the released state, the rear coil segment is tensed to drag the minor ring to angularly move therewith so as to minimize the frictional force therebetween.

U.S. Pat. No. 8,671,928, issued to Hague et al. and assigned to Polarstar Engineering & Machine, discloses a pneumatic assembly for a projectile launching system includes a body defining a continuous bore. A nozzle is positioned within the bore adjacent a forward end and is moveable between a rearward position wherein the nozzle facilitates passage of a projectile through a projectile port and a forward position wherein the nozzle prevents passage of a projectile through the projectile port. The nozzle is biased to the forward position and configured for fluid actuation to the rearward position by activation of a first fluid control valve. A valve seat defines an accumulation chamber rearward of the nozzle. A firing valve member is moveable between a forward position wherein the firing valve member fluidly seals a passage through the valve seat and a rearward position wherein the passage is fluidly opened such that fluid in the accumulation chamber is free to flow through the passage and out of the nozzle. Example embodiments of this pneumatic assembly generally include a nozzle spring contained between the rear surface of the nozzle and the front surface of a center cylinder.

U.S. Patent Application Publication Number 2012/0216786, by Hadley and Calvin, teaches a soft impact projectile launcher including a launching mechanism that creates a burst of air or air pressure in order to launch a projectile. The launching mechanism includes an outer cylinder and a spring-loaded piston configured to generate the burst of air. The projectile launcher may also include a projectile reservoir and a loading member that positions projectiles for launching. The projectile launcher can launch projectiles that are made from a superabsorbent polymer and consist of mostly water.

U.S. Patent Application Publication Number 2013/0247893, by Yang, teaches an airsoft gun structure designed to shunt high-pressure air flow during shooting. Therefore, the shunted high-pressure air flow simulates recoils as real bolt-action, single-shot rifles. Also, the ammunition supply includes different cartridges to select one of the supply-type by the users and whether shell case ejection or not. When operates the airsoft gun, the realistic action is achieved to enhance the fun of shooting. Furthermore, the dual hop up system makes the flight path of bullets more stable without shift. Moreover, the safety gasification system could make the supplied amount of the output compressed high pressure air be almost constant to enhance security during operation. The devices disclosed in Yang include a hammer block spring or magazine spring attached to an inner surface of the back block in an inner barrel.

One of the most valued aspects of airsoft guns is the authentic look of the guns, as the appearance closely adheres to the actual weapons upon which they are replicated. Unfortunately, airsoft rifles, such as M4 style airsoft rifles, typically require the user to wear a compressed air tank to supply compressed air to the airsoft rifle. Thus, the typical user not only suffers the inconvenience of wearing the compressed air tank, but also the unsightly appearance of an air hose leading from the tank to the airsoft rifle. These two complaints are often the reasons cited by potential users of airsoft, or High Pressure Air (HPA), technology that remain resistant to entering the field. Thus, there exists a desire to improve the appearance and functionality of airsoft rifles to eliminate the need for external compressed air tanks.

BRIEF SUMMARY OF THE INVENTION

According to various example embodiments of the present general inventive concept, an in-stock compressed fluid cartridge system is provided to be used in a gas powered airsoft gun. In various example embodiments of the present general inventive concept, the compressed fluid cartridge supplies fluid to a multi-stage expansion chamber configured to depressurize the fluid into gas and prevent fluid from reaching a downstream pressure regulator. In various example embodiments, the compressed fluid cartridge is engaged and disengaged with the in-stock system by turning a thread-less quick release end cap that allows rapid replacement of the cartridges.

Additional aspects and advantages of the present general inventive concept will be set forth in part in the description which follows, and, in part, will be obvious from the description, or may be learned by practice of the present general inventive concept.

The foregoing and/or other aspects and advantages of the present general inventive concept may be achieved by an in-stock compressed fluid cartridge system for a gas powered airsoft gun including a gas delivery assembly configured to deliver gas to an airsoft gun, the gas delivery assembly including a cartridge receiving portion configured to receive at least a portion of a compressed fluid cartridge, a locking cap configured to secure the compressed fluid cartridge in the gas delivery assembly, a puncture pin assembly configured to puncture a nozzle of the compressed fluid cartridge in response to the locking cap being closed over the compressed fluid cartridge, a regulator to regulate a volume of gas passing from the gas delivery assembly, and a plurality of expansion chambers configured to form a tortuous path, between the compressed fluid cartridge and the regulator, to expand liquid in the fluid from the compressed fluid cartridge to gas, and a buffer tube having a first end configured to be coupled to the airsoft gun, and a second end configured to receive the gas delivery assembly such that the buffer tube houses at least a portion of the gas delivery assembly.

The foregoing and/or other aspects and advantages of the present general inventive concept may be achieved by an in-stock compressed fluid cartridge system for a gas powered airsoft gun including a gas delivery assembly configured to deliver gas to an airsoft gun, the gas delivery assembly including a cartridge receiving portion configured with an open end through which to receive at least a portion of a compressed fluid cartridge, a plurality of bosses extending outwardly from an outer circumference of the cartridge receiving portion proximate the open end, a locking cap configured with a closed end, an open end through which to receive at least a portion of the compressed fluid cartridge, and a plurality of guide passages extending from the open end of the locking cap to receive the bosses extending from the cartridge receiving portion such that the locking cap is closed over the open end of the cartridge receiving portion in response to the locking cap being twisted in a first direction, and a buffer tube having a first end configured to be coupled to the airsoft gun, and a second end configured to receive the gas delivery assembly such that the buffer tube houses at least a portion of the gas delivery assembly.

Other features and aspects may be apparent from the following detailed description, the drawings, and the claims.

BRIEF DESCRIPTION OF THE FIGURES

The following example embodiments are representative of example techniques and structures designed to carry out the objects of the present general inventive concept, but the present general inventive concept is not limited to these example embodiments. In the accompanying drawings and illustrations, the sizes and relative sizes, shapes, and qualities of lines, entities, and regions may be exaggerated for clarity. A wide variety of additional embodiments will be more readily understood and appreciated through the following detailed description of the example embodiments, with reference to the accompanying drawings in which.

DETAILED DESCRIPTION

Figure 1:
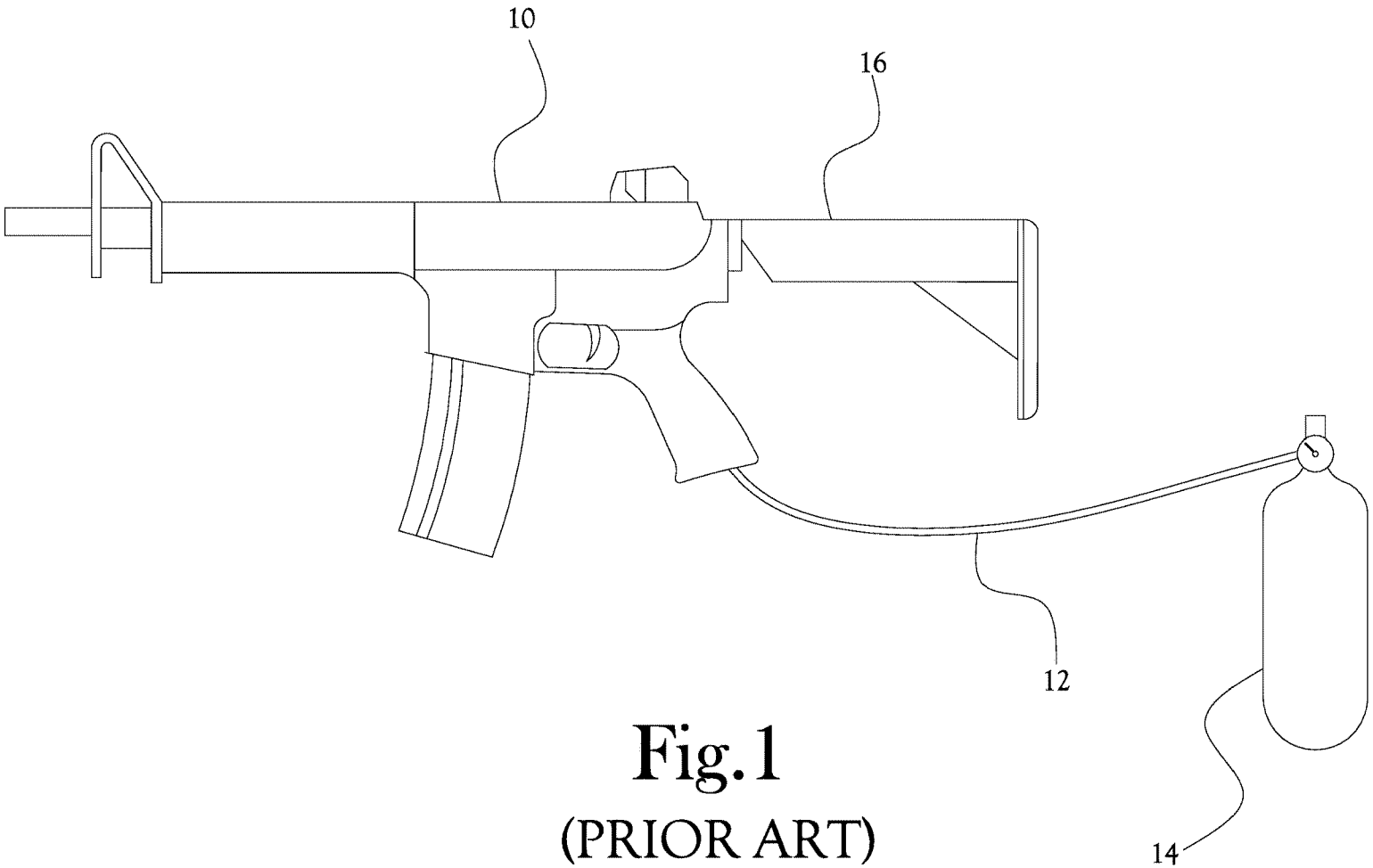
Fig. 1 (PRIOR ART)
FIG. 1 illustrates a conventional gas powered airsoft gun with an external compressed fluid tank.

Reference will now be made to the example embodiments of the present general inventive concept, examples of which are illustrated in the accompanying drawings and illustrations. The example embodiments are described herein in order to explain the present general inventive concept by referring to the figures.

The following detailed description is provided to assist the reader in gaining a comprehensive understanding of the structures and fabrication techniques described herein. Accordingly, various changes, modification, and equivalents of the structures and fabrication techniques described herein will be suggested to those of ordinary skill in the art. The progression of fabrication operations described are merely examples, however, and the sequence type of operations is not limited to that set forth herein and may be changed as is known in the art, with the exception of operations necessarily occurring in a certain order. Also, description of well-known functions and constructions may be simplified and/or omitted for increased clarity and conciseness.

Note that spatially relative terms, such as "up," "down," "right," "left," "beneath," "below," "lower," "above," "upper" and the like, may be used herein for ease of description to describe one element or feature's relationship to another element(s) or feature(s) as illustrated in the figures. Spatially relative terms are intended to encompass different orientations of the device in use or operation in addition to the orientation depicted in the figures. For example, if the device in the figures is turned over or rotated, elements described as "below" or "beneath" other elements or features would then be oriented "above" the other elements or features. Thus, the exemplary term "below" can encompass both an orientation of above and below. The device may be otherwise oriented (rotated 90 degrees or at other orientations) and the spatially relative descriptors used herein interpreted accordingly.

According to various example embodiments of the present general inventive concept, an in-stock compressed fluid cartridge system is provided to be used in a gas powered airsoft gun. In various example embodiments of the present general inventive concept, the compressed fluid cartridge supplies fluid to a multi-stage expansion chamber configured to depressurize the fluid into gas and prevent fluid from reaching a downstream pressure regulator. In various example embodiments, the compressed fluid cartridge is engaged and disengaged with the in-stock system by turning a thread-less quick release end cap that allows rapid replacement of the cartridges. While the example embodiments of the present general inventive concept described herein generally refer to $CO_2$ as the fluid/gas used to power the gas-powered gun, it is understood that other types of compressed fluid may be used in place of $CO_2$. Also, while the example embodiments described herein typically refer to airsoft guns, it is understood that these assemblies and systems may also be incorporated in other gas powered guns or similar high pressure air devices and systems.

FIG. 1 illustrates a conventional gas powered airsoft gun with an external compressed fluid tank. As illustrated in FIG. 1, a conventional airsoft gun 10 typically receives pressurized gas through a hose emanating from a part of the gun 10 and connected to a compressed fluid tank 14 that is worn, carried, etc., by the user of the gun 10. Airsoft rifles such as these typically include a stock 16, which may be adjustable in length. As is evident from FIG. 1, the hose 12 leading to the supply tank 14 has a profoundly negative effect on the aesthetics and verisimilitude of the airsoft gun, which are important to most users who appreciate the otherwise replicated features of the actual weapons upon which the airsoft guns are based. As an adjustable stock 16 has a buffer tube attached to the gun 10 as base on which the shoulder contacting portion rests and/or slides, various example embodiments of the present general inventive concept provide an in-stock compressed fluid cartridge system in which the cartridge and gas delivery assembly may be hidden inside such a buffer tube, allowing the user to enjoy the replica gun 10 without such noticeable eyesores as gas hoses and external tanks.

Figure 2:
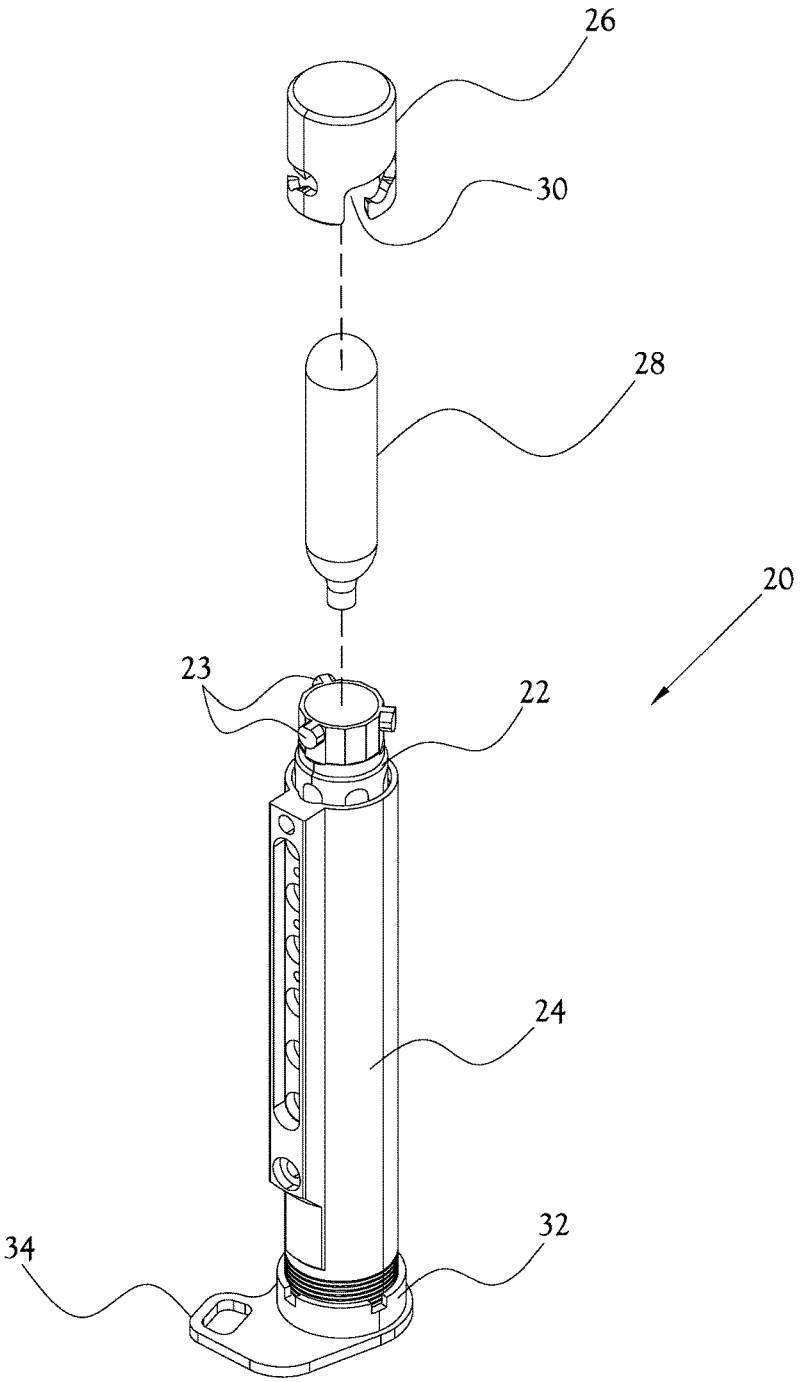
FIG. 2 illustrates a perspective view of various components of an in-stock compressed fluid cartridge system according to an example embodiment of the present general inventive concept.

FIG. 2 illustrates a perspective view of various components of an in-stock compressed fluid cartridge system according to an example embodiment of the present general inventive concept. The example embodiment of the in-stock compressed fluid cartridge system 20 illustrated in FIG. 2 includes a gas delivery assembly 22 provided inside a buffer tube 24, the gas delivery assembly 22 being only partially exposed in this drawing. The gas delivery assembly 22 has a plurality of bosses 23 extending from a location proximate an open end that is configured to receive a compressed fluid cartridge 28. The compressed fluid cartridge 28 is biased inwardly and secured inside the gas delivery assembly 22 by a locking cap 26 that fits over the end of the compressed fluid cartridge 28 and couples to the gas delivery assembly 22 through the interactions of guide passages 30 with the bosses 23, which will be described in more detail herein. Although FIG. 2 shows the gas delivery system 22 and the locking cap 26 as separate entities, the locking cap 26 can be considered as a component of the gas delivery assembly 22. In various example embodiments of the present general inventive concept, the locking cap 26 may be formed so as to be coupled to, or integrally formed with, a compressed fluid cartridge, which in some example embodiments may be re-filled with fluid. A user having a plurality of such locking cap/cartridge assemblies could re-load even more quickly during competition, and in some embodiments refill the cartridges between competitions. The locking cap/cartridge assemblies could be integrally formed, or coupled to one another with a slip fit or other such connection that would securely couple the two members and prevent unwanted disassembly during use. Further, in various example embodiments of the present general inventive concept, the locking cap 26 may actually be formed integrally with the gas delivery system 22 such that a refillable compressed fluid cartridge is fixed therein and may be accessed through a port to refill the refillable compressed fluid cartridge. As illustrated in FIG. 2, the buffer tube 24 appears substantially similar to a buffer tube component of conventional rifles, with a similar castle nut 32 and sling plate 34 assembly to attach the buffer tube 24, and thus the in-stock compressed fluid cartridge system 20, to the airsoft gun.

Figure 3C:
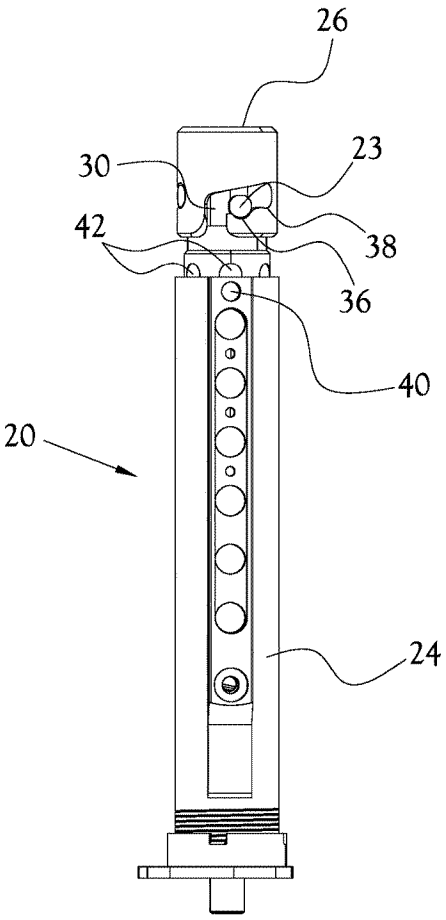
FIG. 3C illustrates a front view of the system of FIG. 2 with the locking cap rotated between an open and closed state.
Figure 3B:
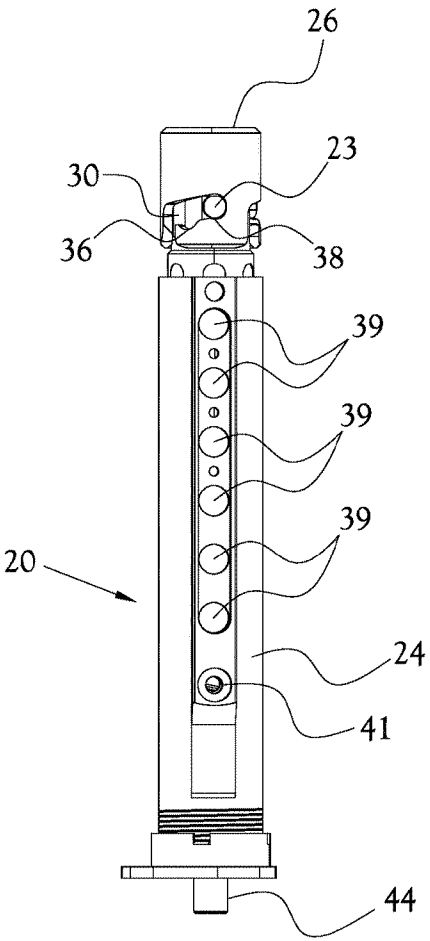
FIG. 3B illustrates a front view of the system of FIG. 2 assembled in a locked configuration.
Figure 3A:
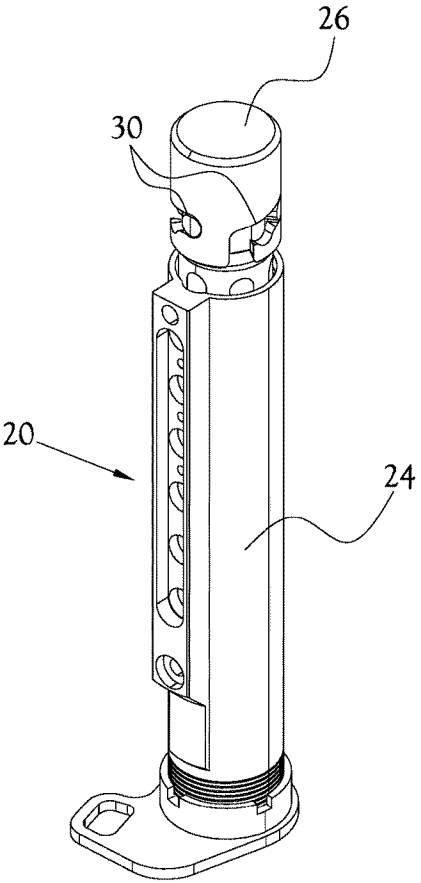
FIG. 3A illustrates a perspective view of the system of FIG. 2 assembled in a locked configuration.

FIG. 3A illustrates a perspective view of the system of FIG. 2 assembled in a locked configuration, FIG. 3B illustrates a front view of the system of FIG. 2 assembled in a locked configuration, and FIG. 3C illustrates a front view of the system of FIG. 2 with the locking cap rotated between an open and closed state. In each of these drawings, a portion the compressed fluid cartridge 28 has been inserted inside the gas delivery assembly 22 via the open end proximate the bosses 23, and the locking cap 26 has been coupled to the bosses 23 of the gas delivery system to secure the compressed fluid cartridge 28 inside the locking cap 26 and receiving portion of the gas delivery assembly 22. The locking cap 26 is provided with guide passages 30 that correspond in number and orientation to the bosses 23. As illustrated in FIGS. 3A-3C, a first portion of these guide passages 30 extend from an open end of the locking cap 26 toward the closed end of the locking cap 26, and a second portion of the guide passages 30 angles away from the first portion but still extends away from the open end of the locking cap 26. Due to such a configuration, by lining the guide passages 30 up with the bosses 23, the locking cap 26 can be pushed in the direction of the gas delivery assembly 22 until the bosses 23 reach the end of the first straight portions of the respective guide passages 30, and then by twisting the locking cap 26 in a clockwise direction the locking cap is biased in the direction of the gas delivery assembly by the interaction of the bosses 23 and the guide passages 30. The example embodiment illustrated in these drawings also includes a plurality of scalloped portions in the angled portions of the guide passages 30. A first scalloped portion 36 is formed proximate the bend of the guide passages 30, and a second scalloped portion 38 is formed proximate the closed end of the guide passages 30. These scalloped portions 36,38 provide extra security to the locking cap when in a locked position and when being removed. When in the fully loaded and locked position, the bosses 23 rest in the second scalloped portions 38 of the guide passages, and the locking cap 26 is thus hampered from any outward movement absent a user twisting the locking cap 26 in a counter-clockwise motion. Similarly, when removing the locking cap 26, the first scalloped portion 36 will aid in the locking cap being blown away from the gas delivery assembly 22 in the presence of an unexpectedly high pressure forcing the compressed fluid cartridge 28 in an outward direction. The first scalloped portion 36 allows the locking cap 26 to be more securely held while the pressure from the compressed fluid cartridge 28 subsides, at which point the user may more safely continue twisting the locking cap 26 in the direction of removal. It is noted that while the guide passages 30 of these example embodiments are configured for clockwise mounting and counter-clockwise removal, various other example embodiments may be otherwise oriented. Also, various example embodiments may include more or less bosses 23 and guide passages 30.

As illustrated in FIGS. 3A-3C, the buffer tube 24 is also provided with adjustable length recesses 39 that may be used to set the shoulder contacting portion of a stock to a desired length, much like a conventional rifle. This also aids in the appearance of the replica airsoft gun. Additionally, the buffer tube 24 includes a cylinder portion length setting aperture 40 to receive a cylinder portion length setting screw to interact with the flats 42 of the gas delivery assembly 22, and which will be described in more detail herein, and an assembly set aperture 41 to receive an assembly set screw to secure the gas delivery assembly in a proper position inside the buffer tube 24. The buffer tube 24 includes a bolt 44 that is used to attach the in-stock fluid cartridge system 20 to the airsoft gun, and through which tubing may be hidden to transmit gas from the gas delivery assembly 22 to the firing mechanism of the airsoft gun.

Figure 4:
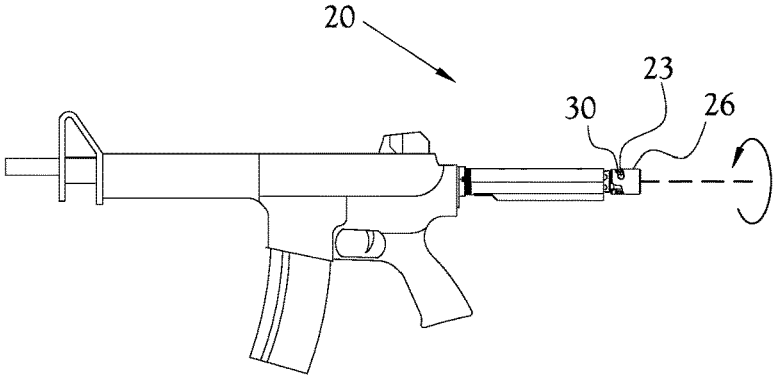
FIG. 4 illustrates the in-stock compressed fluid cartridge system of FIG. 2 installed on an airsoft gun according to an example embodiment of the present general inventive concept.

FIG. 4 illustrates the in-stock compressed fluid cartridge system of FIG. 2 installed on an airsoft gun according to an example embodiment of the present general inventive concept. In the example embodiment illustrated in FIG. 4, the in-stock compressed fluid cartridge system 20 has been installed to an airsoft gun in the same manner as a normal buffer tube, aside from the hidden gas connection extending through the attached end, with the only substantial change in appearance being a small portion of the gas delivery system 22 and the locking cap 26 extending from a distal end of the buffer tube 24. The directional arrow in FIG. 4 indicates that the locking cap 26 has been twisted in a clockwise direction so that the interaction of the bosses 23 and guide passages 30 have locked the locking cap 26, and therefore any compressed fluid cartridge contained therein, into place.

Figure 5A:
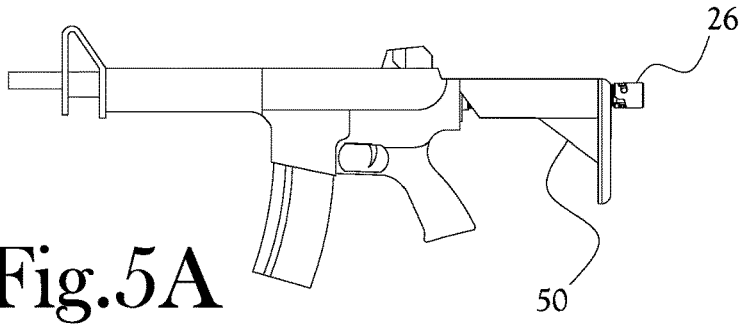
FIGS. 5A-5B illustrate the assembly of FIG. 4 with a shoulder contacting portion of a stock installed on the in-stock compressed fluid cartridge system according to an example embodiment of the present general inventive concept.
Figure 5B:
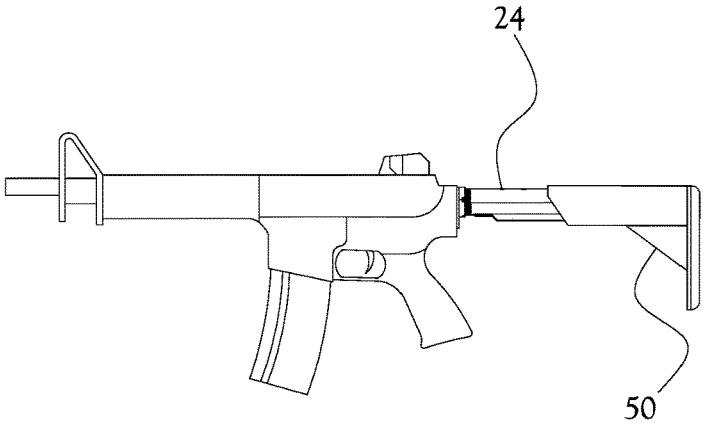

FIGS. 5A-5B illustrate the assembly of FIG. 4 with a shoulder contacting portion of a stock installed on the in-stock compressed fluid cartridge system according to an example embodiment of the present general inventive concept. In FIG. 5A, the shoulder contacting portion 50 has been placed over the buffer tube 24 in a completely collapsed position such that the locking cap 26 can be accessed to change out compressed fluid cartridges. Due to the ease of operation of the locking cap 26, a simple counter-clockwise twist to remove the locking cap 26 can be done in as little as less than a second, followed by a quick replacement of the compressed fluid cartridge and re-installation of the locking cap 26. In FIG. 5B, the shoulder contacting portion 50 of the stock has been extended to cover the locking cap 26. As seen in these drawings, the installation of the in-stock compressed fluid cartridge system 20 vastly improves the appearance of the airsoft guns. And a difference in performance is mostly negligible, as a typical $CO_2$ cartridge will provide a user with approximately 200 shots, and changing the compressed fluid cartridges is a fast and easy operation.

Figure 6:
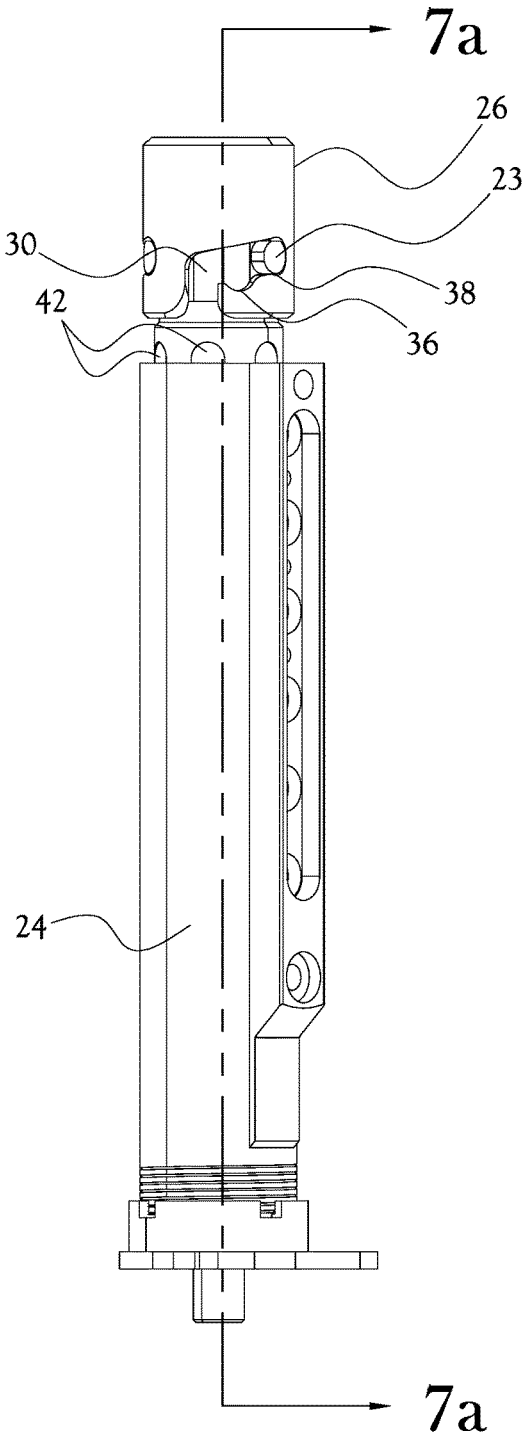
FIG. 6 illustrates a front view of the system of FIG. 2 assembled in a locked configuration, and noting a cut line used for cross sections illustrated in FIGS. 7A-7B.
Figure 7A:
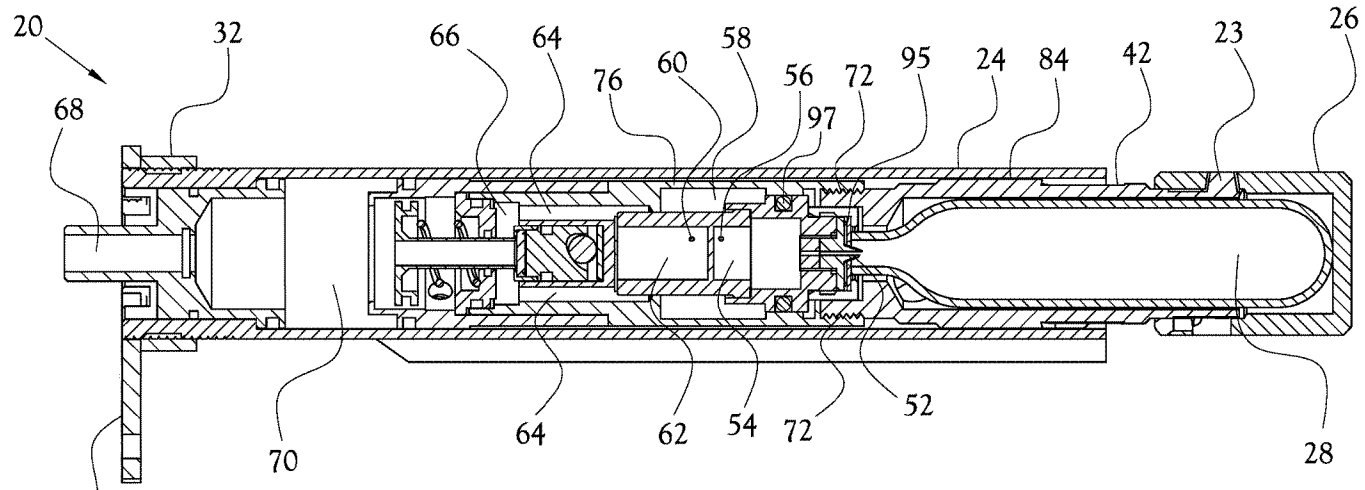
FIG. 7A illustrates a cross section of the system illustrated in FIG. 6 according to an example embodiment of the present general inventive concept.
Figure 7B:
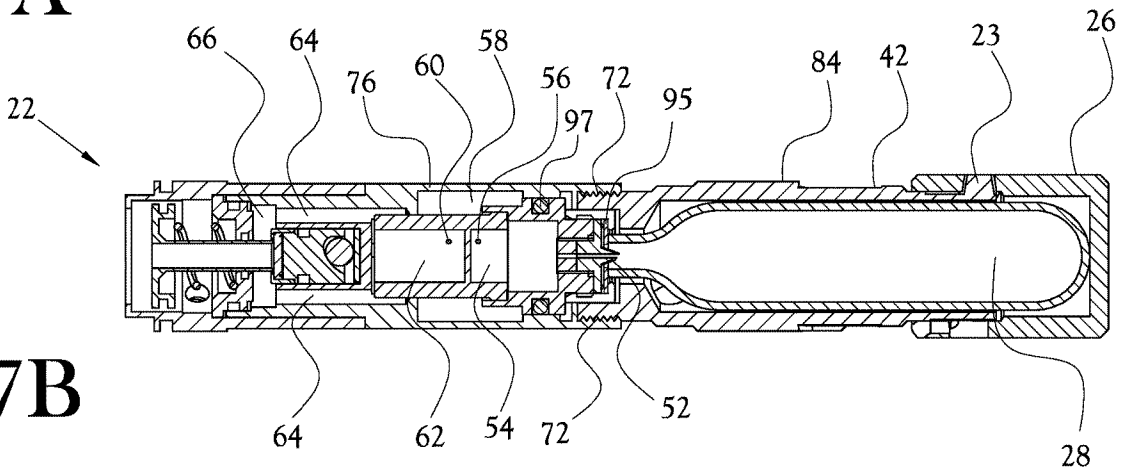
FIG. 7B illustrates a cross section of the gas delivery assembly without the buffer tube assembly in which the gas delivery assembly is installed in FIG. 7A.

FIG. 6 illustrates a front view of the system of FIG. 2 assembled in a locked configuration, and noting a cut line used for cross sections illustrated in FIGS. 7A-7B. FIG. 7A illustrates a cross section of the system illustrated in FIG. 6 according to an example embodiment of the present general inventive concept, and FIG. 7B illustrates a cross section of the gas delivery assembly without the buffer tube assembly in which the gas delivery assembly is installed in FIG. 7A. As illustrated in these example embodiments, when the locking cap 26 is fully secured onto the gas delivery assembly 22, the nozzle of the compressed fluid cartridge 28 is pushed onto a puncture pin 52 with punctures the cartridge 28 to release the compressed fluid therefrom. It is understood that the fluid compressed in the compressed fluid cartridge may include both liquid and gas forms of the fluid, and fluid is used herein as such. The liquids contained in such a compressed fluid begin to depressurize when reaching open space outside the compressed fluid cartridge, and are therefore subsequently converted to gaseous form. In the example embodiment illustrated in FIGS. 7A-7B, fluid passes through a channel in the puncture pin 52 and into multi-stage compression chamber, e.g., a plurality of expansion chambers 54,58,62. In more detail, after exiting the compressed fluid cartridge 28, the fluid flows into a first expansion chamber 54, through a first opening or through-hole 56 into a second expansion chamber 58, and through a second opening or through-hole 60 into a third expansion chamber 62. After the third expansion chamber 62, the fluid, which at this point should be substantially gaseous, moves through a plurality of ports 64 into a regulator 66. The inclusion of the plurality of expansion chambers increases the surface area in contact with the volume of the fluid moving therethrough, and limits the volume of the fluid per unit time that can reach the regulator. With this number of expansion chambers, or fluid phase separators, working in series, the likelihood of any liquid reaching the regulator is substantially reduced. Also, the orientation of the expansion chambers 54,58,62 and through holes 56,60 in this example embodiment results in a fluid path in which the fluid must exit any of the respective expansion chambers in a different direction than in which the fluid entered. The fluid leaves the compressed fluid cartridge 28 and enters the first expansion chamber 54 in an axial direction of the gas delivery assembly 22, but must turn and exit through through-hole 56 in a lateral direction to enter the second expansion chamber 58. The fluid must then exit the second expansion chamber 58 in a direction completely opposite to which it entered, moving through through-hole 60 into the third expansion chamber 62. The fluid must then change direction again to move through the ports 64 in the axial direction of the gas delivery assembly 22. Thus, the plurality of expansion chambers 54,58,62 are configured to form a tortuous path between the compressed fluid cartridge 28 and the regulator 66. This orientation also aids in stopping liquid components of the fluid from traveling straight through to a subsequent expansion chamber, as it may instead "pool" against a wall that is opposite its point of arrival. This is especially valuable in the in-stock compressed fluid cartridge system 20 of the present general inventive concept, as the position and orientation of the system may be constantly changing when the user is simulating combat or is otherwise engaged in a mobile shooting exercise. Liquid components of the fluid are hindered from leaking or "bleeding" into subsequent expansion chambers. In various example embodiments, the through-holes 56,60 may be sized small enough to substantially match the size of a droplet of $CO_2$ at standard temperature and pressure in order to inhibit the passage of liquid from one expansion chamber to another.

The regulator 66 is not described in detail herein, as any number of conventional types of regulators may be employed in various example embodiments of the present general inventive concept. Similarly, although a plurality of ports 64 are illustrated as delivering the resulting gas from the third expansion chamber 62 to the regulator 66, other structures or types of delivery may be used. The gas exiting the regulator 66 may be passed through an exit aperture 68 in the bolt 44 of the buffer tube 24, such as through a hose or other type of conveyance. In various example embodiments such as that illustrated in FIG. 7A, one or more holding or expansion chambers 70 may be formed inside the gas delivery assembly 22 and/or inside the buffer tube 24 between the regulator 66 and the exit aperture 68.

In various example embodiments of the present general inventive concept, the gas delivery assembly 22 is an assembly of at least two housing portions, one being a regulator and expansion chamber housing 76, and another being another being a cartridge receiving member 84. In such a configuration, the housing 76 and the cartridge receiving member 84 may be couple together such that a length of the gas delivery assembly 22 may be adjustable to accommodate different lengths of compressed fluid cartridges. In the example embodiment illustrated in FIGS. 7A-7B, a threading 72 is provided to couple the housing 76 and the cartridge receiving member 84 to move the closed portion of the end cap 26 closer and/or further from the puncture pin 52, so that different sizes of compressed fluid cartridges 28 may be punctured by securing the locking cap 26 in the normal fully secured position. It is noted that the compressed fluid cartridges 28 should typically only be punctured by the twisting motion of the locking cap 26, as the user will likely not have the opportunity to secure the assembly if the cartridge is punctured by any other action. The adjustable length of the gas delivery system 22 will be discussed in more detail in relation to FIG. 9.

Figure 8A:
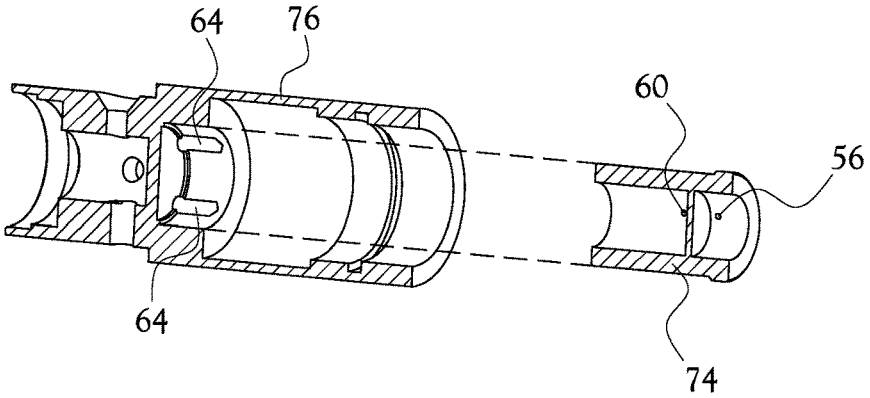
FIGS. 8A-8C illustrate perspective cross sections of components of the in-stock compressed fluid cartridge system that form multi-stage expansion chambers according to an example embodiment of the present general inventive concept.
Figure 8B:
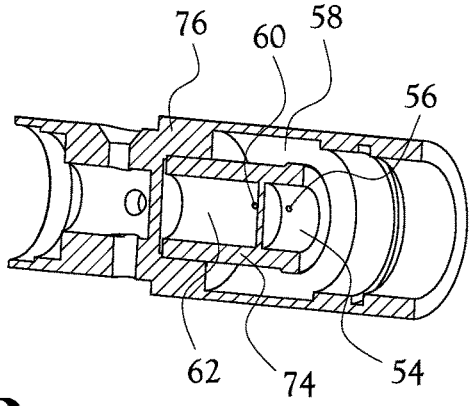
Figure 8C:
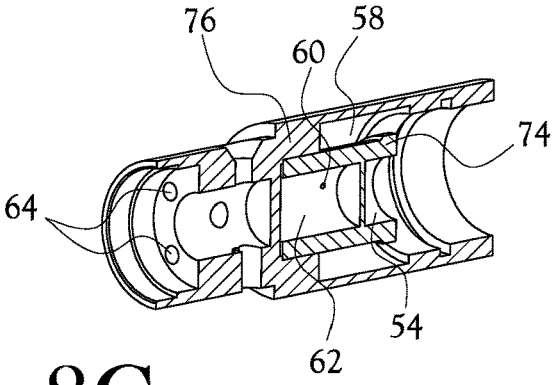

FIGS. 8A-8C illustrate perspective cross sections of components of the in-stock compressed fluid cartridge system that form multi-state expansion chambers according to an example embodiment of the present general inventive concept. In the example embodiment illustrated in FIGS. 8A-8C, the expansion chambers 56,58,60 are formed by a multi-chamber forming member 74 provided inside the regulator and expansion chamber housing 76, which is a portion of the gas delivery assembly 20. By itself, the multi-chamber forming member forms an open-ended first expansion chamber 54 and an open-ended third expansion chamber 62 separated by a partition between the through-holes 56,58. As seen in these drawings, once the multi-chamber forming member 74 is inserted into the regulator and expansion chamber housing 76, the third expansion chamber 62 is substantially closed off by a structure of the housing 76, and the first expansion chamber 54 will be closed off by the puncture pin housing 88 illustrated in FIG. 11. The second expansion chamber is formed by the hollow space surrounding the multi-chamber forming member 74 and inside the housing 76. It is understood that various other example embodiments may provide different structures and/or numbers of expansion chambers and through-holes to form the tortuous path between the compressed fluid cartridge 28 and the regulator 66.

Figure 9:
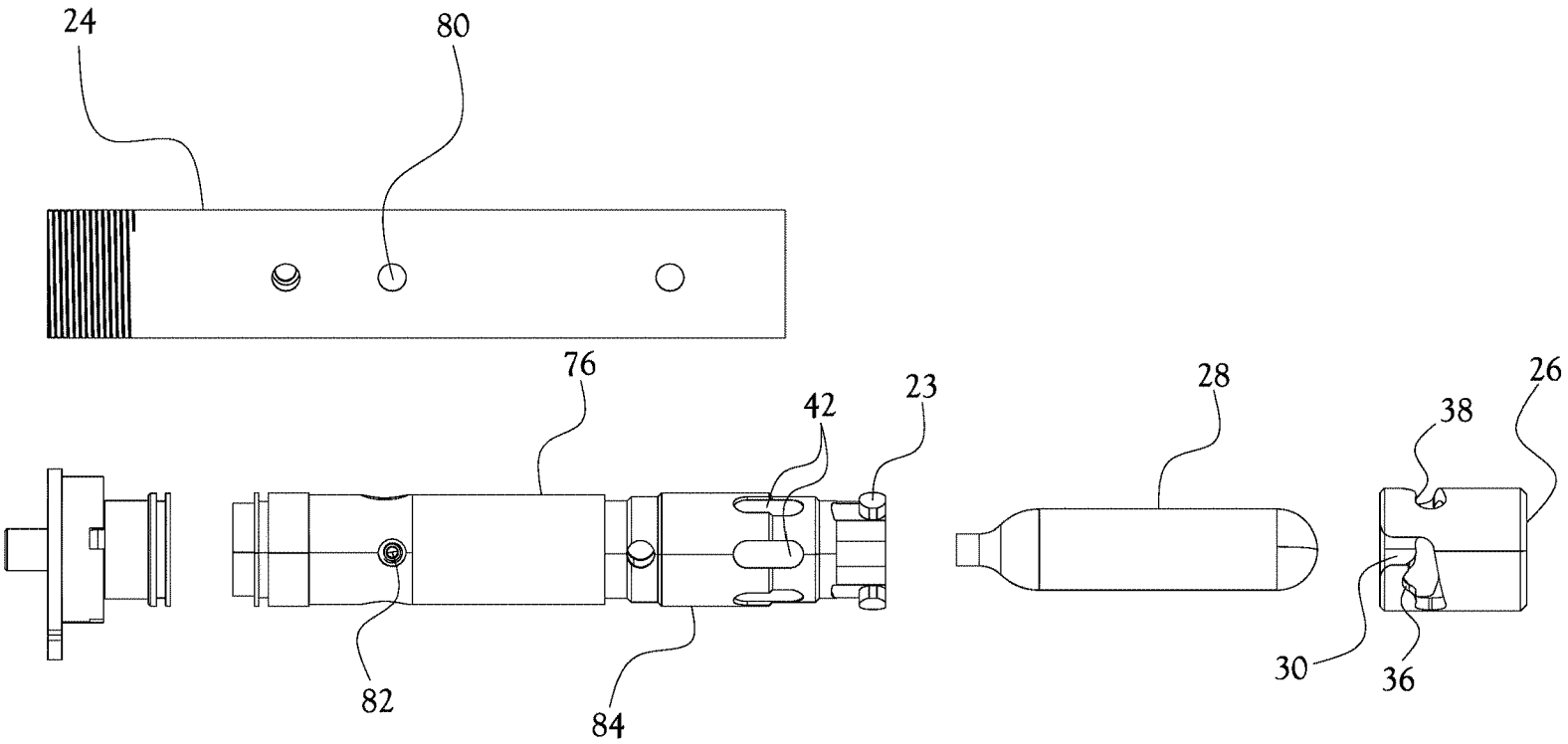
FIG. 9 illustrates a front view of components of the gas delivery assembly outside of the buffer tube assembly according to an example embodiment of the present general inventive concept.

FIG. 9 illustrates a front view of components of the gas delivery assembly 22 outside of the buffer tube 24 assembly according to an example embodiment of the present general inventive concept. As illustrated in the example embodiment of FIG. 9, the buffer tube 24 may be provided with a pressure adjustment aperture 80 that corresponds to a regulator pressure control 82 that is accessible through the regulator and expansion-chamber housing 76. The regulator pressure control 82 may be actuated with, for example, an Allen wrench. Such a feature increases the convenience of a user, who may then adjust the pressure of the gas passed by the regulator 66 without disassembling the in-stock compressed fluid cartridge system 20.

As previously described, a length of the gas delivery assembly 22 may be adjusted by moving the cartridge receiving member 84 in relation to the housing 76. In this example embodiment, the cartridge receiving member 84 and housing 76 are coupled by a threaded connection, and a simple turn of the cartridge receiving member 84 may be employed to adjust the length of the assembly 22. After determining the ideal length of the assembly 22 for the compressed fluid cartridge 28 to be used, e.g., after adjusting the length of the assembly 22 until the locking cap 26 meets a general resistance when being placed over the bosses 23 without piercing the compressed fluid cartridge 28, the length of the assembly 22 may be set by screwing a set screw through the cylinder portion length aperture 40 to interact a corresponding one of the flats 42. By contacting the corresponding one of the flats 42, the cartridge receiving member 84 is prevented from further turning, and therefore further adjusting the length of the assembly 22. The cylinder portion length set screw also aids the assembly set screw in fixing the gas delivery assembly 22 in place inside the buffer tube 24. Various other example embodiments of the present general inventive concept may provide other lengthening structures, such as a slidable connection that may be fixed by one or more fixing members, etc.

Figure 10:
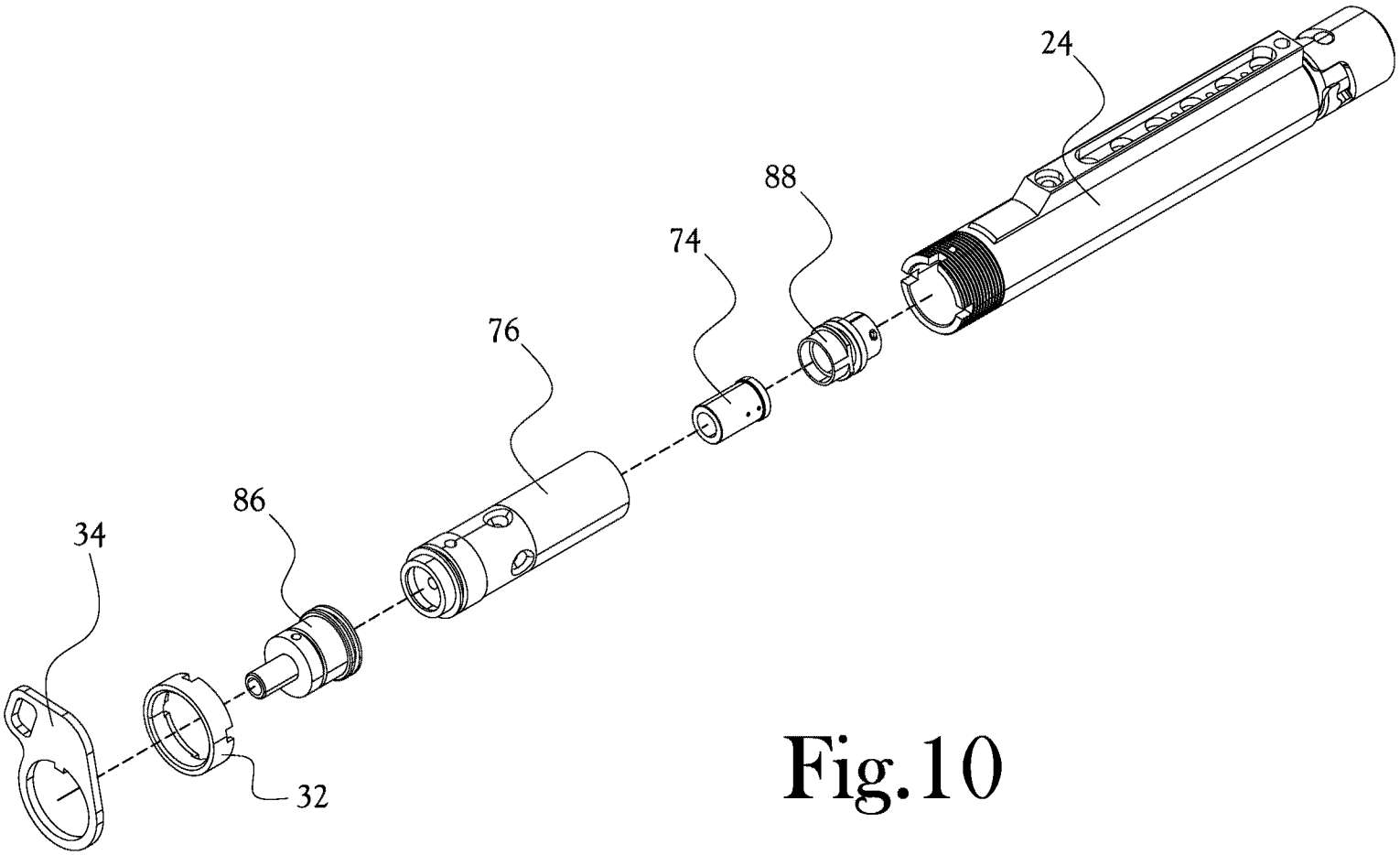
FIG. 10 illustrates an exploded view of various components of the in-stock compressed fluid cartridge system according to an example embodiment of the present general inventive concept.

FIG. 10 illustrates an exploded view of various components of the in-stock compressed fluid cartridge system according to an example embodiment of the present general inventive concept. In the example embodiment illustrated in FIG. 10, a gas delivery nozzle 86 is shown as including the nozzle portion extending through the bolt 44. Also illustrated in FIG. 10 is the puncture pin assembly housing 88 which closes off the open end of the multi-chamber forming member 74 to form the first expansion chamber 54, and which will be discussed in more detail in FIG. 11.

Figure 11:
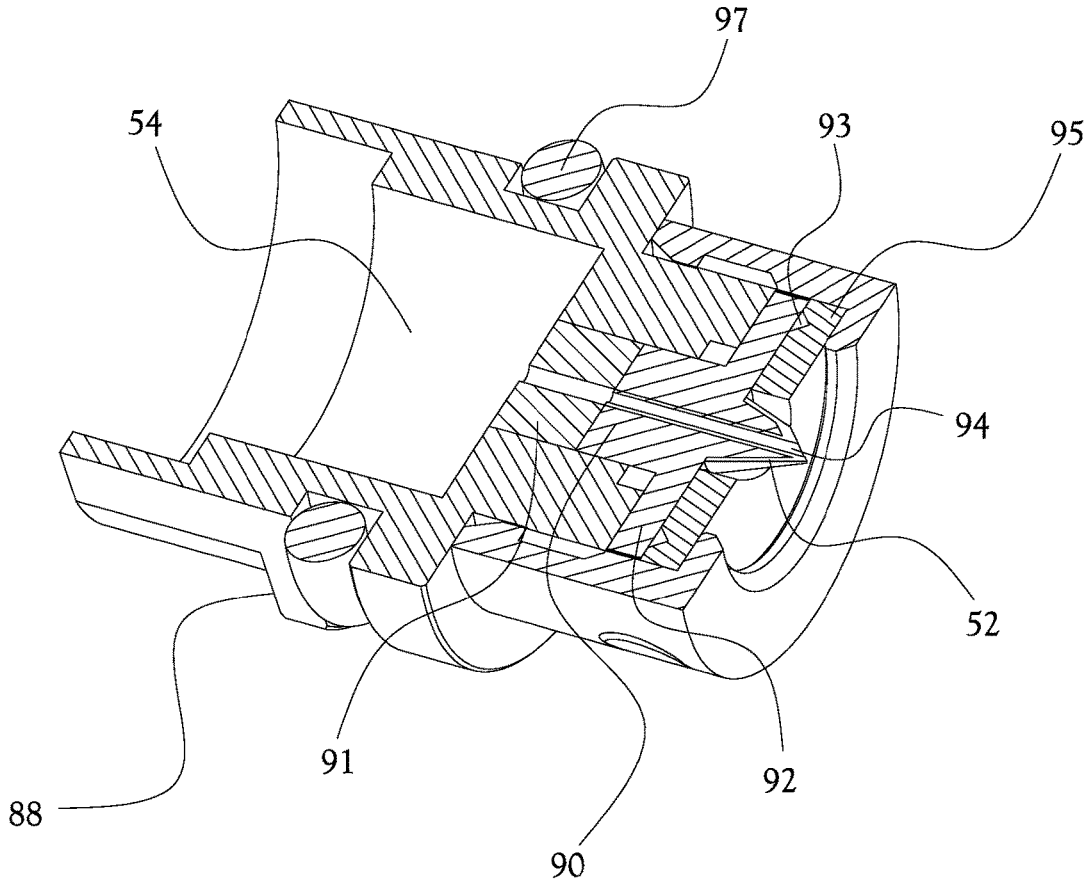
FIG. 11 illustrates a perspective cross section of a puncture pin assembly according to an example embodiment of the present general inventive concept.

FIG. 11 illustrates a perspective cross section of a puncture pin assembly according to an example embodiment of the present general inventive concept. In the example embodiment illustrated in FIG. 11, the puncture pin assembly housing 88 houses therein an open space that forms a portion of the first expansion chamber 54, and is movable from a first stage that occurs before compressed fluid cartridge 28 is punctured by the puncture pin assembly 90, to a second stage that occurs after the puncturing of the cartridge 28. The puncture pin assembly 90 of this example embodiment includes a puncture pin 52, a base 91 extending opposite the puncture pin 52, a flange 92 extending laterally proximate the puncture pin 52, a protrusion such as, for example, a rib 93 extending from the flange 92 in the direction of the puncture pin 52, a gasket or other such sealing member 95 contacting the rib 93 to seal the open portion of the end of the puncture pin assembly housing that receives the nozzle of the compressed fluid cartridge 28, and a channel 94 extending from the puncture pin 52 through the base 91 into the open space 54. It is noted that various example embodiments of the present general inventive concept may include different structures or combinations of structures to effect the puncture pin assembly housing 88. In the example embodiment illustrated in FIG. 11, the puncture pin assembly 90 is fixed relative to the puncture pin assembly housing 88. When a compressed fluid cartridge 28 is pressed against the puncture pin 52 with enough pressure to move puncture pin assembly housing 88, but not enough pressure for the puncture pin 52 to pierce the nozzle of the compressed fluid cartridge 28, the puncture pin assembly housing 88 will be moved in a direction of the multi-chamber forming member 74 until abutting portions of the puncture pin assembly housing 88 and multi-chamber forming member 74 stop the movement of the puncture pin assembly housing 88. When the locking cap 26 is twisted sufficiently that the nozzle of the compressed fluid cartridge 28 is pierced by the puncture pin 52, highly pressurized fluid will move through the channel 94 and into the first expansion chamber 54. The increase in pressure in the first expansion chamber 54 pushes against the base 91 and portions of the puncture pin assembly housing 88 proximate the base 91 and thereby moves the puncture pin assembly housing 88 in the direction of the compressed fluid cartridge 28. A gasket or other such sealing member 97 may be provided around an outer portion of the puncture pin assembly housing 88 to prevent fluid loss around the movable assembly. This movement is limited to the abutment of the puncture pin assembly housing 88 to the cartridge receiving member 84. This movement allows a wider portion of the puncture pin 52 to seal off the opening in the nozzle of the compressed fluid cartridge 28, and further seals off escape of fluid from the first expansion chamber 54, absent that of the through-hole 56 which leads to the second expansion chamber 58.

Various example embodiments of the present general inventive concept provide several features that are attractive to the user of airsoft guns. For example, various example embodiments of the present general inventive concept allows a user to run an HPA engine with 12 gram $CO_2$ cartridges that are completely concealed in the stock. Such a configuration allows approximately 200 shots per $CO_2$ cartridge with a stock M4 setup. The quick-change locking cap allows a user to swap compressed fluid cartridges seamlessly (the record is under 2 seconds). In various example embodiments, the regulator provides an adjustable pressure range of 40-140 psi. Further, the assembly can be retro-fitted to airsoft guns that have previously been set up with external air tanks. Even airsoft guns that do not use such a buffer tube stock may benefit from the compressed fluid cartridge system, as the gas delivery assembly may be coupled to other areas of the gun as an external device, freeing up the user to move more conveniently without a conventional external compressed fluid tank.

The present general inventive concept of the in-stock $CO_2$ cartridge system is not limited to the illustrated example embodiments, or to any one particular type of firing mechanism or any one particular type of airsoft gun. An in-stock $CO_2$ cartridge system is compatible with a number of different firing mechanisms and assemblies.

Various example embodiments of the present general inventive concept provide an in-stock compressed fluid cartridge system for a gas powered airsoft gun including a gas delivery assembly configured to deliver gas to an airsoft gun, the gas delivery assembly including a cartridge receiving portion configured to receive at least a portion of a compressed fluid cartridge, a locking cap configured to secure the compressed fluid cartridge in the gas delivery assembly, a puncture pin assembly configured to puncture a nozzle of the compressed fluid cartridge in response to the locking cap being closed over the compressed fluid cartridge, a regulator to regulate a volume of gas passing from the gas delivery assembly, and a plurality of expansion chambers configured to form a tortuous path, between the compressed fluid cartridge and the regulator, to expand liquid in the fluid from the compressed fluid cartridge to gas, and a buffer tube having a first end configured to be coupled to the airsoft gun, and a second end configured to receive the gas delivery assembly such that the buffer tube houses at least a portion of the gas delivery assembly. At least one through hole may be formed in a common wall between adjacent ones of the expansion chambers along the tortuous path to pass the fluid therebetween. The fluid traveling through the expansion chambers may exit the expansion chambers in a different direction from which the fluid enters the respective expansion chambers. The fluid may move from the compressed fluid cartridge to the regulator sequentially through first, second, and third expansion chambers. The first and third expansion chambers may be formed in an axial direction of the gas delivery assembly and share a common wall therebetween, and the second expansion chamber may be formed around at least portion of both the first and third expansion chambers. The system may further include an exit nozzle provided in the first end of the buffer tube to supply the gas to the airsoft gun. A holding chamber may be formed between the regulator and the exit nozzle. A pressure adjustment aperture may be formed in the buffer tube to provide access to an adjustment mechanism of the regulator. A setting aperture may be provided in the buffer tube to receive an assembly set screw to set a position of the gas delivery assembly inside the buffer tube. The cartridge receiving portion may be coupled to a housing of the puncture pin assembly, expansion chambers, and regulator such that a distance between the locking cap and the puncture pin assembly is adjustable. The cartridge receiving portion is coupled to the housing in a threaded configuration. The system may further include a plurality of flats formed around an outer circumference of the cartridge receiving portion, and a corresponding aperture formed in the buffer tube and configured to receive a cartridge receiving portion length set screw to contact one of the flats to set the distance between the locking cap and the puncture pin assembly. The puncture pin assembly may include a puncture pin, a flange provided proximate the puncture pin, a sealing member provided on a surface of the flange from which the puncture pin extends, a base extending from the flange opposite the puncture pin, and a fluid channel extending from the puncture pin through the base and into a first one of the expansion chambers, wherein the puncture pin assembly may be configured such that a threshold pressure in the first one of the expansion chambers moves the puncture pin assembly in a direction of the compressed fluid cartridge to seal off a portion of a housing of the puncture pin assembly that receives a nozzle of the compressed fluid cartridge.

Various example embodiments of the present general inventive concept may provide an in-stock compressed fluid cartridge system for a gas powered airsoft gun including a gas delivery assembly configured to deliver gas to an airsoft gun, the gas delivery assembly including a cartridge receiving portion configured with an open end through which to receive at least a portion of a compressed fluid cartridge, a plurality of bosses extending outwardly from an outer circumference of the cartridge receiving portion proximate the open end, a locking cap configured with a closed end, an open end through which to receive at least a portion of the compressed fluid cartridge, and a plurality of guide passages extending from the open end of the locking cap to receive the bosses extending from the cartridge receiving portion such that the locking cap is closed over the open end of the cartridge receiving portion in response to the locking cap being twisted in a first direction, and a buffer tube having a first end configured to be coupled to the airsoft gun, and a second end configured to receive the gas delivery assembly such that the buffer tube houses at least a portion of the gas delivery assembly. The system may further include a puncture pin provided in the cartridge receiving portion opposite the open end of the cartridge receiving portion and configured such that the puncture pin punctures a nozzle of the compressed fluid received therein in response to the locking cap being closed over the open end. The guide passages may correspond in quantity and spacing to the bosses. Each of the guide passages may be formed such that a first portion of the guide passages extends from the open end of the locking cap toward the closed end of the locking cap, and a second portion of the guide passages extends at an angle toward the closed end of the locking cap. The second portion of the guide passages include a plurality of scalloped portions extending toward the open end of the locking cap. A first of the scalloped portions is spaced away from a closed end of the second portion of the guide passages, and a second of the scalloped portions is proximate the closed end of the second portion of the guide passages. The scalloped portions may be configured to provide resistance to the locking cap being twisted in a second direction opposite the first direction when pressure is exerted on the locking cap from a compressed fluid cartridge secured inside the cartridge receiving portion.

Numerous variations, modifications, and additional embodiments are possible, and accordingly, all such variations, modifications, and embodiments are to be regarded as being within the spirit and scope of the present general inventive concept. For example, regardless of the content of any portion of this application, unless clearly specified to the contrary, there is no requirement for the inclusion in any claim herein or of any application claiming priority hereto of any particular described or illustrated activity or element, any particular sequence of such activities, or any particular interrelationship of such elements. Moreover, any activity can be repeated, any activity can be performed by multiple entities, and/or any element can be duplicated.

It is noted that the simplified diagrams and drawings included in the present application do not illustrate all the various connections and assemblies of the various components, however, those skilled in the art will understand how to implement such connections and assemblies, based on the illustrated components, figures, and descriptions provided herein, using sound engineering judgment. Numerous variations, modification, and additional embodiments are possible, and, accordingly, all such variations, modifications, and embodiments are to be regarded as being within the spirit and scope of the present general inventive concept.

While the present general inventive concept has been illustrated by description of several example embodiments, and while the illustrative embodiments have been described in detail, it is not the intention of the applicant to restrict or in any way limit the scope of the general inventive concept to such descriptions and illustrations. Instead, the descriptions, drawings, and claims herein are to be regarded as illustrative in nature, and not as restrictive, and additional embodiments will readily appear to those skilled in the art upon reading the above description and drawings. Additional modifications will readily appear to those skilled in the art. Accordingly, departures may be made from such details without departing from the spirit or scope of applicant's general inventive concept.

The invention claimed is:

1. An in-stock compressed fluid cartridge system for a gas powered airsoft gun, comprising:

a gas delivery assembly configured to deliver gas to an airsoft gun, the gas delivery assembly comprising:

a cartridge receiving portion configured to receive at least a portion of a compressed fluid cartridge, a locking cap configured to secure the compressed fluid cartridge in the gas delivery assembly, a puncture pin assembly configured to puncture a nozzle of the compressed fluid cartridge in response to the locking cap being closed over the compressed fluid cartridge, a regulator to regulate a volume of gas passing from the gas delivery assembly, and a plurality of expansion chambers configured to form a tortuous path, between the compressed fluid cartridge and the regulator, to expand liquid in fluid from the compressed fluid cartridge to gas; and a buffer tube having a first end configured to be coupled to the airsoft gun, and a second end configured to receive the gas delivery assembly such that the buffer tube houses at least a portion of the gas delivery assembly.

2. The system of claim 1, wherein at least one through hole is formed in a common wall between adjacent ones of the expansion chambers along the tortuous path to pass the fluid therebetween.

3. The system of claim 2, wherein the fluid traveling through the expansion chambers exits the expansion chambers in a different direction from which the fluid enters the respective expansion chambers.

4. The system of claim 3, wherein the fluid moves from the compressed fluid cartridge to the regulator sequentially through first, second, and third expansion chambers.

5. The system of claim 4, wherein the first and third expansion chambers are formed in an axial direction of the gas delivery assembly and share a common wall therebetween, and the second expansion chamber is formed around at least portion of both the first and third expansion chambers.

6. The system of claim 1, further comprising an exit nozzle provided in the first end of the buffer tube to supply the gas to the airsoft gun.

7. The system of claim 6, wherein a holding chamber is formed between the regulator and the exit nozzle.

8. The system of claim 1, wherein a pressure adjustment aperture is formed in the buffer tube to provide access to an adjustment mechanism of the regulator.

9. The system of claim 1, wherein a setting aperture is provided in the buffer tube to receive an assembly set screw to set a position of the gas delivery assembly inside the buffer tube.

10. The system of claim 1, wherein the cartridge receiving portion is coupled to a housing of the puncture pin assembly, expansion chambers, and regulator such that a distance between the locking cap and the puncture pin assembly is adjustable.

11. The system of claim 10, wherein the cartridge receiving portion is coupled to the housing in a threaded configuration.

12. The system of claim 10, further comprising:

a plurality of flats formed around an outer circumference of the cartridge receiving portion; and a corresponding aperture formed in the buffer tube and configured to receive a cartridge receiving portion length set screw to contact one of the flats to set the distance between the locking cap and the puncture pin assembly.

13. The system of claim 1, wherein the puncture pin assembly comprises:

a puncture pin;

a flange provided proximate the puncture pin;

a sealing member provided on a surface of the flange from which the puncture pin extends;

a base extending from the flange opposite the puncture pin; and a fluid channel extending from the puncture pin through the base and into a first one of the expansion chambers, wherein the puncture pin assembly is configured such that a threshold pressure in the first one of the expansion chambers moves the puncture pin assembly in a direction of the compressed fluid cartridge to seal off a portion of a housing of the puncture pin assembly that receives a nozzle of the compressed fluid cartridge.

* * * * *